US006797330B1

(12) United States Patent
Bush et al.

(10) Patent No.: US 6,797,330 B1
(45) Date of Patent: Sep. 28, 2004

(54) COATING APPARATUS AND PROCESSES THEREOF

(75) Inventors: Steven D. Bush, Red Creek, NY (US); Raphael A. Marcello, Webster, NY (US); Richard A. Vangrol, Fairport, NY (US); James R. Lee, Sodus Point, NY (US); Eugene A. Swain, Webster, NY (US)

(73) Assignee: Xerox Corporation, Stanford, CT (US)

( * ) Notice: Subject to any disclaimer, the term of this patent is extended or adjusted under 35 U.S.C. 154(b) by 54 days.

(21) Appl. No.: 10/317,231

(22) Filed: Dec. 11, 2002

Related U.S. Application Data

(62) Division of application No. 09/790,095, filed on Feb. 22, 2001, now Pat. No. 6,562,135.

(51) Int. Cl.[7] ..... B05D 1/18

(52) U.S. Cl. ..... 427/430.1; 118/406; 118/407; 118/408; 118/423; 118/428; 118/429; 118/500; 118/505

(58) Field of Search ..... 118/428, 500, 118/505, 406, 404, 407, 408, 423, 429; 427/430.1

(56) References Cited

U.S. PATENT DOCUMENTS

| | | | | | |
|---|---|---|---|---|---|
| 3,667,988 | A | * | 6/1972 | Horiki | 427/482 |
| 4,325,320 | A | * | 4/1982 | Kirisawa | 118/52 |
| 4,620,996 | A | * | 11/1986 | Yashiki | 427/430.1 |
| 4,845,172 | A | * | 7/1989 | Brytus et al. | 525/481 |
| 5,021,089 | A | * | 6/1991 | Kuwata et al. | 106/2 |
| 5,358,296 | A | * | 10/1994 | Kilmer et al. | 294/98.1 |
| 5,616,365 | A | * | 4/1997 | Nealey | 427/430.1 |
| 5,683,742 | A | | 11/1997 | Herbert et al. | 427/11 |
| 5,693,372 | A | | 12/1997 | Mistrater et al. | 427/430.1 |
| 5,725,667 | A | | 3/1998 | Petropoulos et al. | 118/407 |
| 5,820,897 | A | | 10/1998 | Chambers et al. | 425/522 |

* cited by examiner

*Primary Examiner*—Katherine A. Bareford
(74) *Attorney, Agent, or Firm*—Fay, Sharpe, Fagan, Minnich & McKee, LLP

(57) ABSTRACT

An apparatus including: a tank with a closed base end and an open top end, and adapted to contain a coating formulation; and a receiver member with at least a cone shape, where the base of the cone is attached to the interior and to the base end of the tank and adapted to receive an article for coating.

7 Claims, 4 Drawing Sheets

COATING APPARATUS AND PROCESSES THEREOF

CROSS-REFERENCE TO RELATED APPLICATIONS

This is a divisional of application Ser. No. 09/790,095, filed Feb. 22, 2001 now U.S. Pat. No. 6,562,135.

REFERENCE TO COPENDING AND ISSUED PATENTS

Attention is directed to commonly owned and assigned, applications U.S. Ser. No. 09/466,565 filed Dec. 17, 1999, now U.S. Pat. No. 6,214,419, discloses a process for immersion coating of a substrate comprising positioning a substrate having a top and bottom within a coating vessel having an inner surface to define a space between the inner surface and the substrate, filling at least a portion of the space with a coating mixture; stopping the filling slightly below the top of the substrate, initiating removal of the coating mixture at a gradually increasing rate to a predetermined maximum flow rate in a short predetermined distance, and continuing removal of the coating mixture at substantially the predetermined maximum flow rate to deposit a layer of the coating mixture on the substrate; U.S. Ser. No. 09/450,363, filed Nov. 29, 1999, which discloses a process including: providing a hollow imaging drum having a first end, a second end, an outside surface, an inside surface and coating material on both the inside surface and the outside surface at least the first end; simultaneously contacting the coating material on both the inside surface and the outside surface at the first end of the drum with resilient foam material contacts the first end drum, the foam material being insoluble in the flowing solvent; producing relative movement between the foam material and the drum to simultaneously wipe both the inside surface and the outside surface of the first end of the drum with the foam material and solvent material and simultaneously remove coating material from the inside surface and the outside surface of the first end of the drum; and flowing the solvent away from the drum to carry away coating material removed from the inside surface and the outside surface of the first end of the drum; U.S. Ser. No. 09/416,824 and 09/416,840 now U.S. Pat. No. 6,177,219, both filed Nov. 12, 1999, and U.S. Ser. No. 09/576147 now U.S. Pat. No. 6,156,468.

The disclosures of each the above mentioned copending applications or patents are incorporated herein by reference in their entirety. The appropriate components and processes of these applications may be selected for the materials and processes of the present invention in embodiments thereof.

BACKGROUND OF THE INVENTION

The present invention is generally directed to a coating apparatus and method of coating articles, such as hollow cylindrical articles, for example, photoresponsive devices used in imaging apparatuses and the like applications. More specifically, the present invention relates to an improved coating apparatus and coating method for articles and which apparatus and method obviates or minimizes the need to conduct a so-called bottom-edge-wipe step or operation and which step is common in conventional coating apparatus and coating methods. The present invention provides coated articles with superior and unexpected coating properties, such as reduced or eliminated coating defects, such as bubbles entrapped in the resulting coated article.

In electrophotography, and particularly in xerographic copying machines, coated substrates such as photoreceptor belts or cylindrical photoreceptor drums are common. Photoreceptor embodiments include at least one coating of photoconductive material, which can be formed on the photoreceptor by known techniques such as immersion or dip coating.

The end regions of a coated photoreceptor are commonly used to either or both engage, for example, with flanges, the printer's or copier's drive mechanism and to support a developer housing. If the developer housing rides on the coated area at one end region of the drum, the coating composition can be rubbed-off and which rub-off particles can contaminate various components in the machine such as the cleaning system and any optical exposure systems employed in the machine. Also, the coating can interfere with devices or componentry that is designed to electrically ground the drum by merely riding on the outer surface at one end region of the drum. Thus, preferably both the outer and inner end regions of a photoreceptor generally must be free of the coating composition.

In dip coating, the upper end region of the photoreceptor drum might be kept free of coating composition by orienting the drum vertically and dipping the drum into a bath of coating composition to a predetermined depth which avoids coating the upper end region. However, the coating formed over the lower region end of the photoreceptor must still be removed, for example, by mechanically or manually wiping the lower end region or by applying solvents to it. This solvent removal procedure can be problematic since it may employ environmentally harmful solvents. Also, the coating removal procedure may require the use and maintenance of special equipment in the clean room which can increase activity in the clean room, thereby decreasing productivity. In addition, the coating removal procedure a clean room increases costs since the procedure must meet clean room requirements. Alternatively, the end regions of the photoreceptor drums may be masked to prevent coating of the end regions. However, the mask must be removed from the photoreceptor drum subsequent to the dip coating process which is disadvantageous since this involves an additional step. Consequently, there is a need, which the present invention addresses, for a coating method which eliminates or minimizes the above-identified problems.

Photoresponsive articles or devices are comprised generally of a transport layer and a photogenerator layer. These devices may include a wide variety of additional or supplemental layers or coating and which coatings can provide enhanced performance properties or adaptable configurational features to the resulting coated device. The photoresponsive devices of the present invention are useful, for example, as imaging members in various electrostatographic imaging systems, including those systems wherein electrostatic latent images are formed on the imaging member. Additionally, the photoresponsive devices of the present invention can be irradiated with light, for example, as generated by a known laser or other suitable light source, to accomplish, for example, latent image formation by, for example, charged area discharge (CAD) or dark area discharge (DAD) methodologies.

Numerous photoresponsive devices for electrostatographic imaging systems are known including selenium, selenium alloys, such as arsenic selenium alloys; layered inorganic photoresponsive, and layered organic photoresponsive devices. Examples of layered organic photoresponsive devices include those containing a charge transport layer and a charge generator layer, or alternatively a photogenerator layer. Thus, for example, an illustrative layered organic photoresponsive device can be comprised of a conductive substrate, overcoated with a charge generator layer, which in turn is overcoated with a charge transport layer, and an optional overcoat layer overcoated on the charge transport layer. In a further "inverted" variation of this device, the charge transporter layer can be overcoated with the photogenerator layer or charge generator layer. Examples of generator layers that can be employed in these devices include, for example, charge generator materials such as pigments, selenium, cadmium sulfide, vanadyl phthalocyanine, x-metal free phthalocyanines, dispersed in binder resin, while examples of transport layers include dispersions of various diamines, reference for example, U.S. Pat. No. 4,265,990, the disclosure of which is incorporated herein by reference in its entirety.

There continues to be a need for improved photoresponsive devices, and improved methods and apparatus for making such devices. Additionally, there continues to be a need for methods and apparatus which reduce defects and provide improved performance properties of the resulting coated photoresponsive devices, and which devices are economical to prepare and can retain their properties over extended periods of time. Furthermore there continues to be a need for photoresponsive devices that permit both normal and reverse copying of black and white as well as full color images, especially in high speed digital printing systems.

PRIOR ART

In U.S. Pat. No. 5,683,742, to Herbert, et al., issued Nov. 4, 1997, there is disclosed a coating method for a substrate having an end region comprising: a) rubbing a non-wetting material across the end region to adhere the non-wetting material to the end region; and b) contacting a portion of the substrate including the end region with a coating composition, whereby the coating composition adheres to the substrate surface free of the non-wetting material and the non-wetting material minimizes adherence of the coating composition to the end region.

In U.S. Pat. No. 5,616,365, to Nealey, issued Apr. 1, 1997, there is disclosed a method for coating a substrate having an end region including: a) positioning the substrate within a coating vessel to define a space between the vessel and the substrate and providing a downwardly inclined surface contiguous to the outer surface at the end region of the substrate; b) filling at least a portion of the space with a coating solution; and c) withdrawing the coating solution from the space, thereby depositing a layer of the coating solution on the substrate.

In U.S. Pat. No. 5,693,372, to Mistrater et al., issued Dec. 2, 1997, there is disclosed a process for dip coating drums comprising providing a drum having an outer surface to be coated, an upper end and a lower end, providing at least one coating vessel having a bottom, an open top and a cylindrically shaped vertical interior wall having a diameter greater than the diameter of the drum, flowing liquid coating material from the bottom of the vessel to the top of the vessel, immersing the drum in the flowing liquid coating material while maintaining the axis of the drum in a vertical orientation, maintaining the outer surface of the drum in a concentric relationship with the vertical interior wall of the cylindrical coating vessel while the drum is immersed in the coating material, the outer surface of the drum being radially spaced from the vertical interior wall of the cylindrical coating vessel, maintaining laminar flow motion of the coating material as it passes between the outer surface of the drum and the vertical interior wall of the vessel, maintaining the radial spacing between the outer surface of the drum and the inner surface of the vessel between about 2 millimeters and about 9 millimeters, and withdrawing the drum from the coating vessel.

In U.S. Pat. No. 5,725,667, to Petropoulos et al., issued Mar., 10, 1998, there is disclosed a dip coating apparatus including: a) a single coating vessel capable s of containing a batch of substrates vertically positioned in the vessel, wherein there is absent vessel walls defining a separate compartment for each of the substrates; b) a coating solution disposed in the vessel, wherein the solution is comprised of materials employed in a photosensitive member and including a solvent that gives off a solvent vapor; and c) a solvent vapor uniformity control apparatus which minimizes any difference in solvent vapor concentration encountered by the batch of the substrates in the air adjacent the solution surface, thereby improving coating uniformity of the substrates.

In U.S. Pat. No. 5,820,897, to Chambers et al., issued Oct. 13, 1998, there is disclosed a method of holding and transporting a hollow flexible belt throughout a coating process. The method includes placing an expandable insert into the hollow portion of a seamless flexible belt, and expanding the insert until it forms a chucking device with a protrusion on at least one end. A mechanical handling device is then attached to the protrusion, and will be used to move the chuck and the belt through the dipping process, as materials needed to produce a photosensitive device are deposited onto the surface of the belt, allowing it to be transformed into an organic photoreceptor. The chucking device and flexible belt are then removed from the mechanical handling device, the belt is cut to the desired width, and the chuck is removed from the inside of the photoreceptor.

The aforementioned references are incorporated in their entirety by reference herein.

SUMMARY OF THE INVENTION

Embodiments of the present invention, include:

An apparatus comprising:
- a tank with a closed base end and an open top end, and adapted to contain a coating formulation; and
- a receiver member with at least a cone shape, where the base of the cone is attached to the interior and to the base end of the tank and adapted to receive an article for coating;

A coating method comprising:
- press fitting an article for coating onto the base portion of the receiver member of the abovementioned coating apparatus; and
- partially filling the tank with a coating solution;
- removing the coating solution from the tank; and
- removing the resulting coated article from the receiver member, wherein the interior of the article is free of residual coating solution.

An article comprising:
- a conofrustum solid adapted for attachment within a coating vessel, where the solid is constructed of a partially compressible material, such as a closed cell foam or closed cell sponge, and adapted to receive and support an object for dip or immersion coating.

These and other embodiments of the present invention are illustrated herein.

DETAILED DESCRIPTION OF THE INVENTION

The present invention, in embodiments provides an apparatus comprising:

- a tank with a closed base end and an open top end, and adapted to contain a coating formulation; and
- a receiver member with at least a cone shape, where the base of the cone is attached to the interior and to the base end of the tank and adapted to receive an article for coating.

Figure 1:
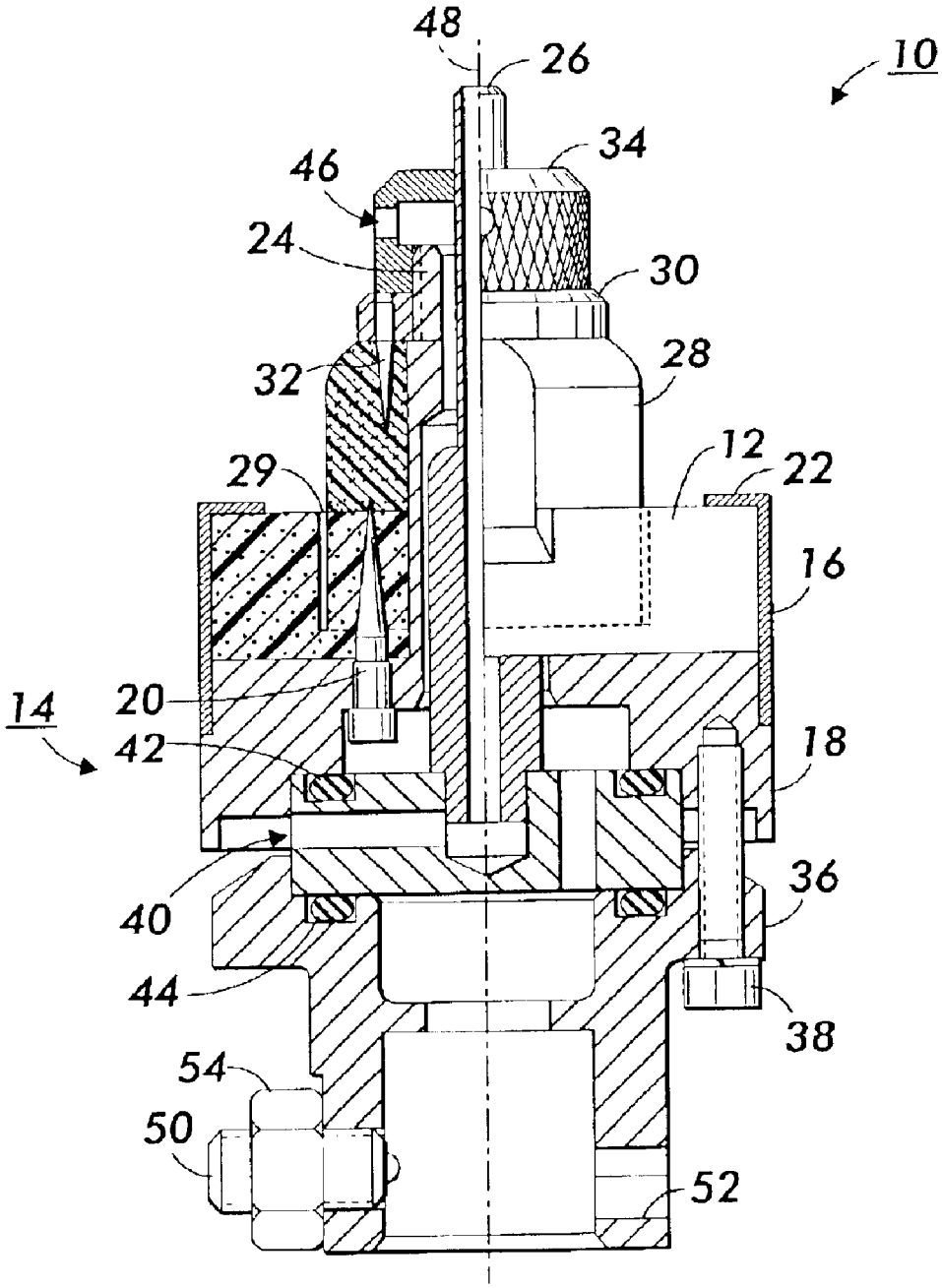
FIG. 1 illustrates a cross-section view of a related cleaning assembly.

Turning to the Figures, FIG. 1 illustrates a cross-section view of a related cleaning assembly 10, reference the aforementioned commonly owned and assigned copending application U.S. Ser. No. 09/450,363 the disclosure of which is incorporated by reference herein in its entirety, comprising a cleaning foam 12 retained in a housing 14 comprising a bowl ring 16 removably mounted on a base 18. Secured to base 18 is at least one threaded spike 20 which penetrates cleaning foam 12 and prevents it from turning during cleaning. An optional bowl lip 22 along the upper periphery of bowl ring 16 ensures retention of cleaning foam 12 during cleaning. Any suitable housing 14 may be utilized to retain the cleaning foam 12 during the coating removal operation. The housing may be solid, foraminous, notched, and the like. The housing is sufficiently rigid to retain the foam in position during the cleaning operation. Generally, where a bowl lip 22 is omitted, the cleaning foam 12 is sufficiently compressed when confined within the housing 14 to achieve a friction fit which retains the foam in the housing during the coating removal cycle. Alternatively, retaining members may be used to prevent slippage. Any suitable retaining member may be utilized. Typical retaining members include, for example, pins, spikes, knurled interior surfaces of the housing (not shown) and the like. Secured to and extending upwardly from base 18 is a hollow shaft 24 having an upper externally threaded end. Coaxially enclosed within and spaced from hollow shaft 24 is a vent tube 26. A resilient guide spindle 28 is positioned around shaft 24 and on top of cleaning foam 12. Cleaning foam 12 contains a circular slit 29 having a diameter equal to or slightly smaller than the largest diameter of resilient guide spindle 28. Pin washer 30 carries at least one pin 32 which becomes imbedded into resilient guide spindle 28 when threaded screw cap 34 is screwed onto the upper threaded end of hollow shaft 24. Threaded screw cap 34 also presses resilient guide spindle 28 against cleaning foam 12 to ensure retention of cleaning foam 12 within housing 14 during the cleaning operation. Base 18 is securely fastened to shaft flange 36 by a plurality of bolts 38. Spacer ring 40 is sandwiched between base 18 and shaft flange 36 with O-rings 42 and 44 providing solvent tight seals to allow solvent to be fed through hollow connecting passageways extending through shaft flange 36, spacer ring 40, base 18, hollow shaft 24 and screw cap 34. Screw cap 34 contains at least one exit opening 46 to allow solvent to exit screw cap 34 and flow downwardly over guide foam 28 onto cleaning foam 12. Guide spindle 28 contains at least one groove 48 to enhance flow of solvent to clean cleaning foam 12. Instead of, or in combination with, flow of solvent from exit opening 46, solvent may be fed directly to cleaning foam 12 by holes or ducts (not shown) in hollow shaft 24 or base 18 adjacent to cleaning foam 12. Shaft flange 36 also carries a ball plunger 50 and a quarter turn pin slot 52. Hex nut 54 facilitates adjustment of ball plunger 50.

Figure 2:
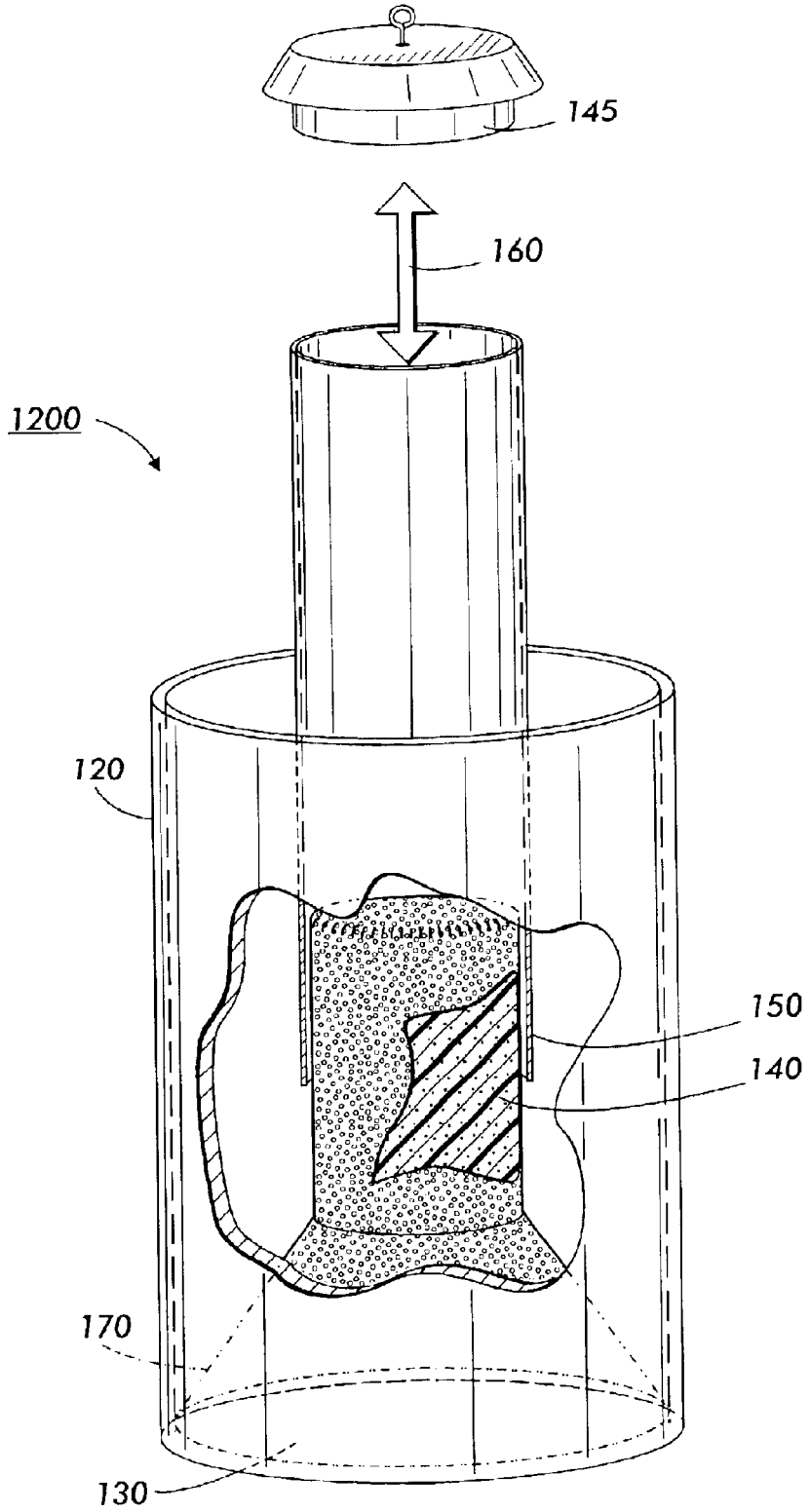
FIG. 2 illustrates a perspective view of a coating apparatus in embodiments of the present invention with an article for coating or a substrate being positioned on a receiver member.

FIG. 2 illustrates a perspective view of a coating apparatus 1200 of the present invention including a tank 120 with a base end 130 or closed end 130, a receiver member 140 with at least a conofrustum shaped base 170, and an article 150 for coating, such as a photoreceptor drum or belt. The article can be positioned in the coating apparatus by, for example, manual or mechanical means, such as by hand or a robotic elevator 160 (not shown). An optional top end cap or plug 145 can be included to facilitate movement and positioning of the article and to further seal the top end of the article from inadvertent coating formulation or solvent contamination of the interior of the article. Plug 145 can be attached and positioned within and on the end of article 150 by for example press-fit, snap-fit, screw top, and the like known fastener methods and means.

Figure 3:
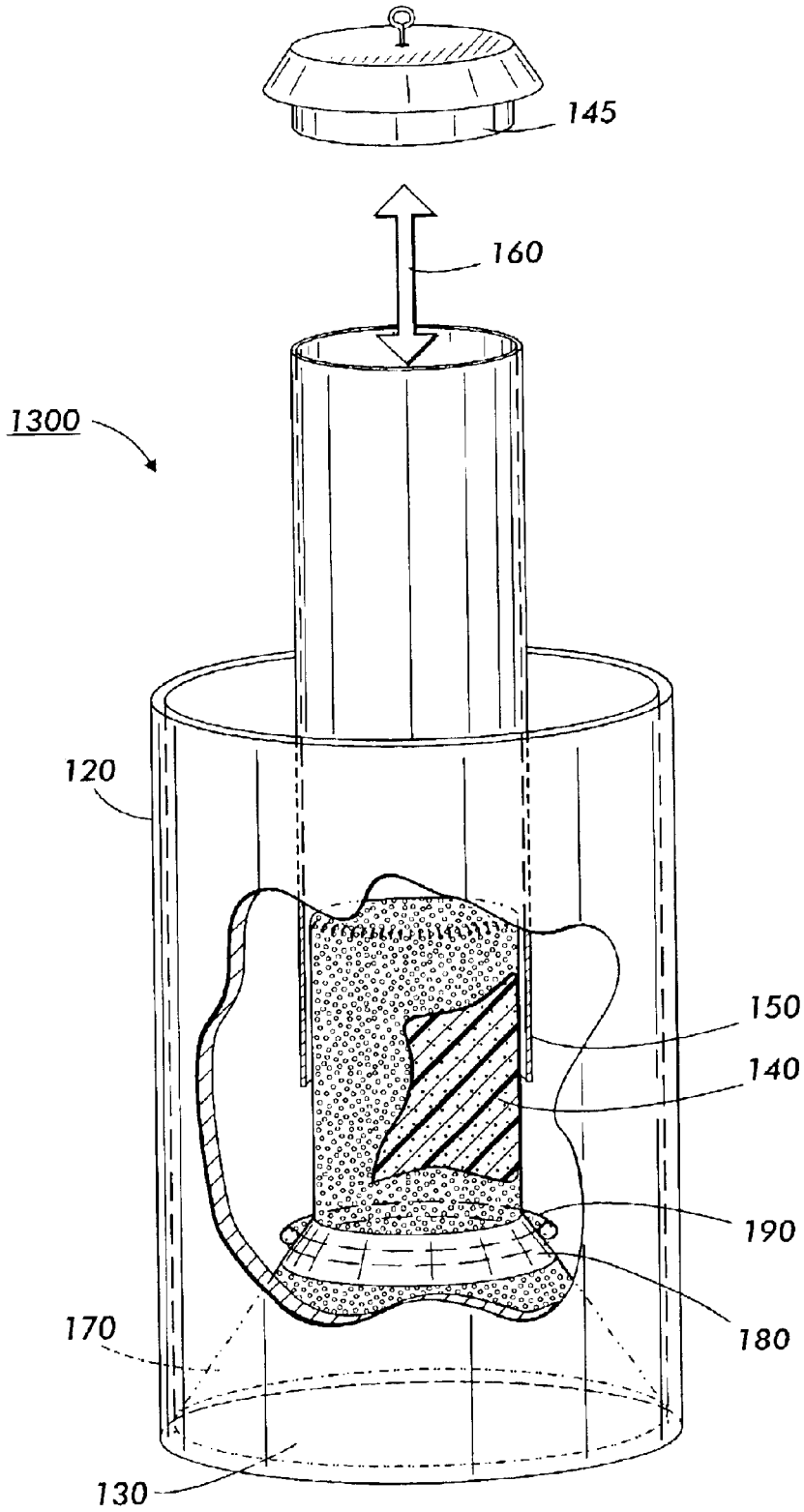
FIG. 3 illustrates a perspective view of an alternative receiver member construction showing an integral seal member or sleeve member.

Similarly FIG. 3 illustrates a perspective view, in an alternative embodiment, of coating apparatus 1300 including a tank 120 with a base end 130 or closed end 130, an alternative receiver member 140 with at least a conofrustum shaped base 170, and an article 150 for coating, such as a photoreceptor drum or belt. The article can be positioned as described in FIG. 2 by manual or mechanical means 160 (not shown). An optional top end cap or plug 145 can be included as described above. The alternative receiver member 140 with base 170 can further include an additional seal member 180 or sleeve member 180. The seal or sleeve 180 can be integral to or attached to the receiver member base 170 and can include a rolled lip 190 or rolled seal 190 structure. The sleeve and lip members work to receive the end of the article 150 and to seal the interior of the article from ingress of coating formulation or solvent. Examples of a suitable seal material are coating formulation compatible flexible plastics or rubbers, such as molded or rolled dental dam, polyethylene, or copoly (ethylene-propylene), silicone rubbers, and the like materials.

Figure 4:
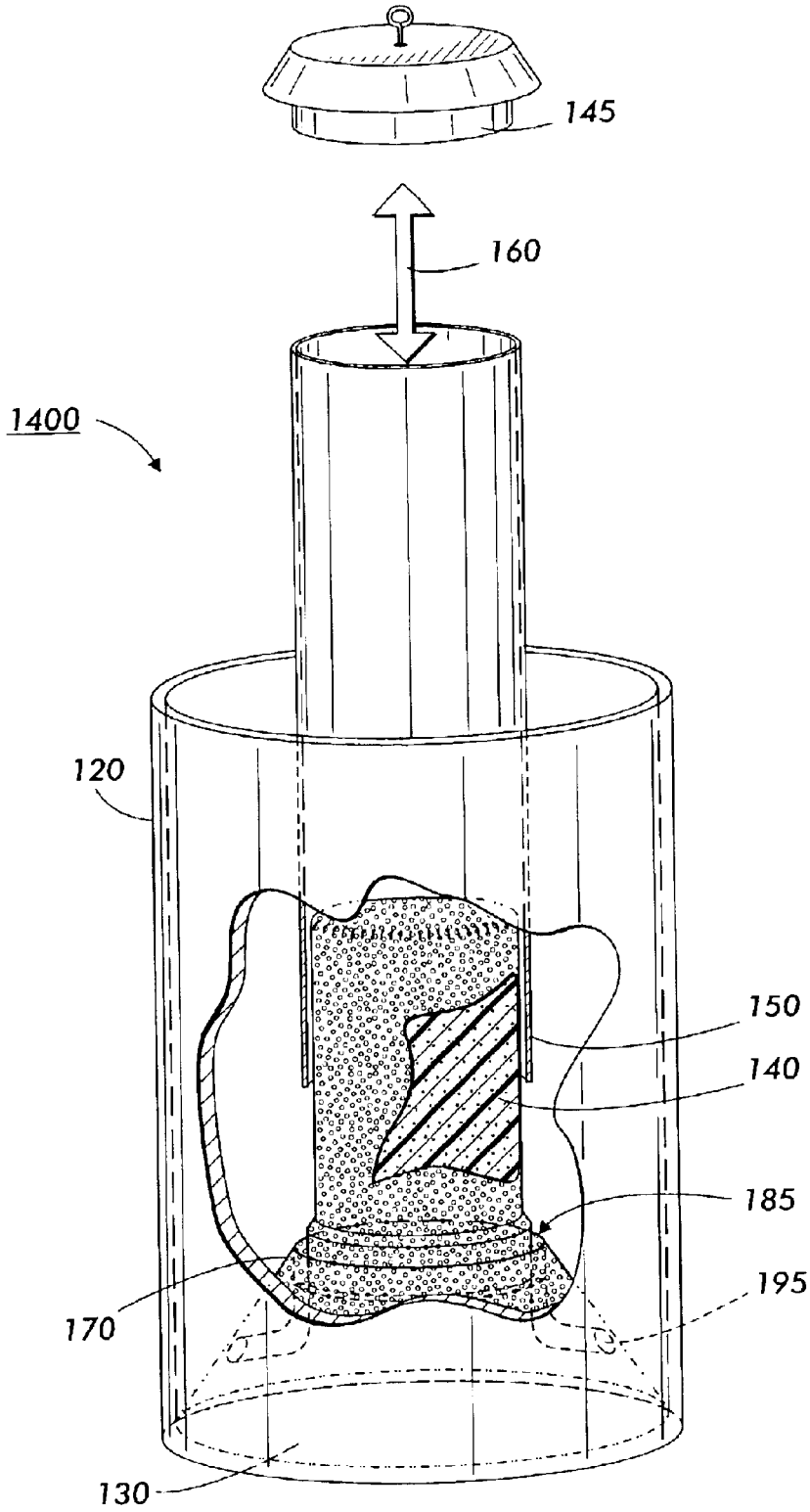
FIG. 4 illustrates a perspective view of another alternative receiver member construction showing an integral and recessed or inset seal member or sleeve.

FIG. 4 illustrates a perspective view, in an alternative embodiment, of a coating apparatus 1400 including the above mentioned tank 120 with a base end 130, an alternative receiver member 140 with at least a conofrustum shaped base 170, and an article 150 for coating, such as a photoreceptor drum or belt. The article can be positioned as described in FIG. 2 by manual or mechanical means 160 (not shown). An optional top end cap or plug 145 can be included as described above. The alternative receiver member 140 with base 170 can further include an additional integral and recessed inset seal member 185 or gutter member 185. The recessed seal 185 can include one or more optional drain(s) 195 or conduit(s) 195 which permit drainage and return to the main cavity of inadvertent leakage or seepage of solvent or coating formulation into the recessed seal 185. The recessed seal 185 works to receive and position the end of the article 150 and to seal the interior of the article 150 from ingress of coating formulation or solvent. The seal can be easily fashioned by, for example, when molding, such as by injection, or machining the receiver member. Alternatively the recessed seal 185 and conduit(s) 195 can be further lined with other functional materials, such as non-swelling rubber or tubing to facilitate receipt and positioning of the article 150.

It will readily evident to one of ordinary skill in the art that the present invention can be applied to either or both dip coating and immersion coating processes. In immersion coating process embodiments the coating apparatus of the present invention incorporates the above mentioned receiver member and which receiver member is attached or affixed to the interior of the tank, and preferably the receiver member is attached to the base of the tank since the receiver article can facilitate, for example, drainage and recovery of coating formulation and cleaning solvents, with beveled or sloped sides of the conofrustum base 170. In dip coating process embodiments the receiver member 140 of the present invention preferably is fitted or joined with the article 150 for coating and the resulting assembled combination of the article and receiver member are thereafter lowered into the tank containing a coating formulation.

In embodiments the receiver member can have a first conofrustum shape and which member is permanently or reversibly attached to the base of the tank at the widest base end of the first shape, and the receiver member can have a second cylindrical shape surmounting the narrower top end of the first shape, reference FIGS. 2 through 4.

The receiver member can have a solid and substantially conofrustical shape, a combined conofrustical and cylindrical shape, or a cone shape. In embodiments the receiver member can be simply a compressible cone shaped solid attached permanently or reversibly at its base to the base of the tank. The receiver member can have a first portion or first shape that approximates a frustum of a cone and which shape can be further surmounted by a second cylinder shape which is attached to the narrower or smaller end of the conical frustum portion of the receiver member. The larger end or base end of the conical frustum portion of the receiver member is attached to the base of the tank. Alternatively, if desired, the receiver member can have a single conofrustum shape, that is, a cone shaped frustum with a flat base and a flat top and without a second surmounting cylindrical shape. In a preferred embodiment the receiver member has both a first conical frustum shaped base which base is surmounted by a second cylinder shape approximating a cylinder. The cone shaped frustum portion of the receiver member provides a vertical support and seal structure and the cylinder shape portion of the receiver provides a lateral support structure and an alignment structure or guide structure for the article to be coated. The receiver member in embodiments can provide for a precise and reversible fit, orientation, and seal to the article for coating and without the need, for example, additional moving parts. The volume area between the solid shape of the receiver member and the inner wall of the tank defines a cavity. The volume area of the cavity is modified and reduced by the introduction and mounting of the article for coating on the receiver member. The article for coating can be introduced into the cavity, for example, by manual or mechanical mechanisms, including robotics, and is preferably securely mounted on the receiver member. A securely mounted article is one which is placed or held in place on the receiver member to exclude coating formulation from contacting the interior surface of the article for coating and to exclude coating formulation from contacting that portion of the receiver member which is circumscribed by the article for coating. Thus the first shape of the receiver member is adapted to form a leak proof seal between the interior surface of the article for coating and the coating formulation. The second shape is adapted to be isolated from the coating formulation by the article for coating. The second shape is preferably entirely shielded by or completely covered by the article for coating, that is, the second shape preferably is not contacted by coating solution. In embodiments, the receiver member is preferably free of any contact with the outer surface of the article for coating, that is, the receiver member contacts the article only at its end and its interior surface and not its exterior surface. In other embodiments, such as illustrated in FIGS. 3 and 4, a portion of the exterior surface, of the article can be covered or concealed by the aforementioned optional seal or gutter structures. In embodiments the article for coating can be, for example, a hollow cylinder or drum with a diameter less than the diameter of the tank, a conformable continuous endless belt, or a drelt, and the like article geometries. The tank can be any suitable structure which can contain the receiver, article and coating formulation, for example, a hollow cylinder or drum, a continuous endless belt, or a drelt, with the cylindrical axis oriented vertically, and with a permanently or reversibly sealed end or base. The receiver member is preferably constructed of a partially compressible sponge material. Preferably the foam material is compressed only a small amount, if any. A primary objective is for the very bottom edge of a photoreceptor for coating to barely contact the sponge. This contact can range from, for example, greater than about 0.1 millimeters to less than about 2 millimeters across a representative batch of 20 similar photoreceptor devices, such as drums or belts.

A suitable sponge material is, for example, the ETHAFOAM™ line of products, commercially available from Dow Corning Corp. An exemplary foam used in a high density dip photoreceptor manufacturing facility can be, for example, a medium density of about 2.3 pounds per cubic feet (pcf. While many different density materials were found to be satisfactory, it was found that ETHAFOAM™ standard packaging foam material was superior to others tested, such as urethane foam, natural latex foam, and neoprene foam, and is readily available commercially such as from Chamberlain Rubber, Henrietta, N.Y. In embodiments the ETHAFOAM™ material with a 1.7 pcf rating was subjected to 7 pounds per square inch (p.s.i.) pressure to compress the material about 10 percent by volume. The compression test method for this material was ASTM D 3575, suffix D. Additional test results and test information are available at the Dow Chemical web site www.dow.com, see also www-.fpcfoam.com which discloses, among other foam materials, ETHAFOAM™ Select and 1.7 pcf which are exemplary polyethylene foams for use in the present invention that are strong, resilient, low-density (1.7 pcf), closed-cell foams. ETHAFOAM™ Select and 1.7 pcf are ideally suited as a component material in products requiring a shock absorbing, vibration dampening, insulating, barrier, or buoyancy component, and as a material for cushioning components in packaging applications for impacts or loadings up to 2.0 p.s.i. or less. Limiting water absorption or solvent inbibation of closed cell foam materials is an important consideration in selecting the foam materials for use in the present invention. Foams with a large fraction of open cells will readily absorb water or solvents with resulting undesirable or unsatisfactory property changes. ASTM D 3575 test standard can also be used to evaluate and select suitable foam materials and provides, for example, a method for evaluating the water absorbed by foam samples subjected to submersion under a 10 feet (about 3 meters) water head at room temperature for 48 hours. A similar modified test can be used to evaluate non-aqueous solvent inbibation.

The receiver member is preferably constructed from a closed cell foam. In a preferred embodiment the closed cell foam is comprised of at least one polyethylene polymer or copolymer. The closed cell foam has a nominal closed cell size of less than or equal to about 3.0 millimeters, and can have a nominal closed cell size of, for example, from about 0.01 to about 3.0 millimeters, preferably the closed cell foam has a cell size of from about 0.1 to about 3.0 millimeters, and more preferably a cell size of from about 1.0 to about 3.0 millimeters. Cell sizes evaluated were, for example, from about 0.5 millimeters to about 3.5 millimeters. All cell size ranges evaluated performed comparably well for mounting, seepage prevention, and wipe avoidance. However, it was found that the foams with larger cell sizes had longer sponge life, whereas smaller celled materials had a tendency to plug with solids which plugging can limit the sponge life.

The coating formulation can be a solution or dispersion of at least one resin. A preferred coating formulation for coating photoreceptors is, for example, a mixed metal oxide $TiSiO_2$ containing coating formulation which is disclosed in the aforementioned commonly owned and assigned patent applications U.S. Ser. No. 09/416,824 and 09/416,840 now U.S. Pat. No. 6,177,219, both filed Nov. 12, 1999, and commonly owned and assigned U.S. Pat. No. 6,156,468, which discloses for example a $SiO_2$ loaded coating composition, the disclosures of these patent applications are incorporated herein by reference in their entirety.

The receiver member can be integral to the base of the tank, for example, a monolithic structure or single piece structure which can be integrally molded to the base of the tank. Alternatively, the receiver member can be fastened to the base of the tank by any known and suitable fastener. Known fasteners include but are not limited to, for example, a screw, a bolt, a clamp, a weld, an adhesive which is insoluble in the coating formulations or cleaning solutions, and the like fasteners.

In embodiments the receiver member can further comprise a mask or seal member adapted to accommodate and fully cover one end and at least a portion of the outer surface of the article for coating and which end and surface are in contact with a modified receiver member. For example, an elastic belt or seal member situated on and around the conofrustum portion of the receiver member and where the article for coating is partially covered and protected from the coating material by the belt or seal member, reference FIG. 3. Alternatively, the receiver member can include a substantially vertically oriented slit, groove, trough, gutter, or the like race-type void, and which slit or void snuggly accommodates one end and a portion of the outer surface of the article for coating. The slit can optionally include drainage conduits that permit residual coating formulation or cleaning flush solvents to escape from the slit and be removed from the tank, reference for example, FIG. 4.

In embodiments of the present invention there is provided a coating method comprising:

press fitting an article for coating onto the base portion of the receiver member of the above mentioned coating apparatus, for example, where the receiver member has at least a conofrustum shape;

partially filling the tank with a coating solution;

removing the coating solution from the tank; and removing the resulting coated article from the receiver member, wherein the interior surface of the article is free of residual coating solution.

"Partially filling" the tank with a coating solution refers to introducing coating solution or formulations into the tank to the extent necessary to achieve a desired coating result on the exterior of the article for coating. Preferably the coating formulation fills in the tank and does not exceed the height of the article being coated. Alternatively or additionally, the article being coated can include the aforementioned plug or cap in the distal or outer end of the article, that is the top end of the article, to preclude or limit coating formulation overfill, overflow, or inadvertent splash of coating formulation or cleaning solvent from entering or contaminating the interior surface of the article. If desired the resulting coated article can be removed before the coating solution is removed. This alternative removal sequence may be less desirable in embodiments since the second cylindrical shaped portion of the receiver member is more likely to become contaminated or fouled with the coating formulation.

In embodiments the method of the present invention can reduce, prevent, or remedy coating defects in the resulting coated article by, for example, from about 1 to about 25 percent compared to a coating apparatus without a conofrustum shaped receiver member. Particular defects observed in prior art coating apparatuses are, for example, the known "defect #14" which is any bubble contained in the charge transport layer(CTL). The bubble in the layer can be created when the photoreceptor enters the coating solution. This bubble can generally be removed by the bottom edge wipe (BEW) unit of the present invention. Although not wanting to be limited by theory it is believed that prior to the development of the present invention there was no convenient method to remove coating entrapped bubbles without removing the charge generator layer (CGL) and CTL layers, for example, from the bottom 4 to 10 millimeters of the drum or article for coating. Another defect effectively eliminated or minimized by the present invention is the known "defect #56" which defect is observed, for example, as a rough "run-and-sag" border on the bottom of the drum or article for coating. This defect can be easily caused by the outside BEW sponge, for example, when a photoreceptor article being coated is not evenly set onto the top of a receiver or support member. In embodiments the present invention can be applied to a coating apparatus which incorporates two or more receiver members, for example, and array of from 2 to about 50 receivers, situated within the same coating tank or vessel to enable high volume batch coating or semi-continuous coating operations. In an exemplary embodiment an 4×5 array or 20 receiver members are accommodated in a single coating vessel. In a comparative example which produced undesirable results, when a photoreceptor substrate for coating was manually driven down onto the lowest possible position on conventional receiver member or BEW head, such as in a 4×5 coating array, the BEW head that was the highest would wipe up onto the charge generator layer (CGL) and charge transport layer. This wiping caused the coated layers to run and sag. The resulting run and sag in the resulting coating layers is the above mentioned defect #56. In embodiments of the present invention the rate of defect #14 can be reduced by, for example, from about 5 to about 0.04 percent and the rate of defect #56 can be reduced by from about 10 to about 0.5 percent.

In embodiments the present invention provides an article for use in coating other articles comprising a receiver member with at least a portion comprising a conofrustum solid shape and which receiver is adapted for attachment within a coating vessel. The receiver member can be constructed of a partially compressible material, such as a closed cell foam or sponge material, and adapted to receive and support a hollow object, such as an article for dip or immersion coating, for example, a drum, an endless belt, a web, and the like articles.

The present invention provides in embodiments an electrostatographic article comprising:

a substrate;

a charge generator layer overcoated on the substrate;

a charge transport layer overcoated on the charge generator; and an optional known overcoat, undercoat, intermediate coatings, and the like performance layers or coatings, wherein at least one layer or coating of the article is applied with abovementioned coating apparatus and method.

The coating apparatus and coating processes of the present invention can eliminate the need for masking the ends of the article or photoreceptor during exterior surface or outer surface coating processes. The coating apparatus and coating processes of the present invention can eliminate one or more bottom-edge-wipe step or steps associated with conventional dip coating or immersion coating processes. The coating apparatus and coating processes of the present invention can, for example: simplify coating processes and the manufacture of coated photoreceptors articles; enable or facilitate automation of coating apparatuses and processes; produce higher product yields by reducing defects or rejects; and require few or fewer moving mechanical parts. The coating apparatus and coating processes of the present invention can also conserve coating formulation usage and coating formulation costs, and can minimize coating waste, solvent usage, and solvent waste.

The finished coated articles of the present invention, such as imaging members, photoreceptors, electroreceptors and the like articles, may be used in a variety of imaging devices and imaging processes.

The coating compositions may include layered materials which are employed in the fabrication of, for example, magnetic recording media and electrical components having conducting resistive, dielectric or semi-conducting layers thereon. Other applications include the formation of protective coatings, decorative coatings, sizing coatings, key coats, light or heat absorbing coatings, light or heat reflective coatings, heat conducting coatings, slip coatings, non-slip coatings, anti-corrosion coatings, anti-static coatings and abrasive coatings on appropriate substrate materials such as metal or metals, alloys, paper, glass, ceramics, ceramers, fabrics, plastics, combinations thereof, and the like materials.

The coating composition or coating compositions to be applied to the article for coating can preferably be materials typically employed in the fabrication of an electrostatographic imaging member, especially in the fabrication of a photoreceptor. A description of suitable materials for the coatings and of suitable materials for the supporting substrate follows.

The Article for Coating (Substrate)

The article for coating or substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, mixtures thereof, and the like. The electrically insulating or conductive substrate may be flexible, semi-rigid, or rigid, and may have any number of different configurations such as, for example, a sheet, a scroll, an endless flexible belt, a cylinder, and the like geometries which can be adapted to the receiver member of the coating apparatus. The substrate may be in the form of an endless flexible belt which can comprise a commercially available biaxially oriented polyester known as MYLAR™, available from E. I. du Pont de Nemours & Co., or MELINEX™, available from I.C.I. Americas Inc. The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, for example, 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods.

The Electrically Conductive Ground Plane

The electrically conductive ground plane may be an electrically conductive metal layer which may be formed, for example, on the coating article or substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission. Regardless of the technique employed to form the metal layer, a thin layer of metal oxide may form on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4,000 Angstroms and about 9,000 Angstroms or a conductive carbon black dispersed in a plastic binder as an opaque conductive layer.

The Blocking Layer

After deposition of the electrically conductive ground plane layer, the blocking layer may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_4]CH_3Si(OCH_3)_2$, (gamma-aminopropyl)-methyl diethoxysilane, as disclosed in U.S. Pat. 4,338,387, 4,286,033 and 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable hole blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The blocking layer is continuous and may have a thickness of less than about 10 micrometers because greater thicknesses may lead to undesirably high residual voltage. A hole blocking layer of between about 0.005 micrometer and about 1.5 micrometers is preferred because charge neutralization after the exposure step is facilitated and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 5:100 is satisfactory for spray coating.

The Adhesive Layer

Intermediate layers between the blocking layer and the adjacent charge generating or photogenerating layer may be desired to promote adhesion. For example, the adhesive layer may be employed. If such layers are utilized, they preferably have a dry thickness between about 0.001 micrometer to about 0.2 micrometer. Typical adhesive layers include film-forming polymers such as polyester, du Pont 49,000 resin, available from E. I. du Pont de Nemours & Co., VITEL-PE100™, available from Goodyear Rubber & Tire Co., polyvinylbutyral, polyvinylpyrrolidone, polyurethane, polymethyl methacrylate, and the like materials.

The Imaging Layer(s)

The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006, the disclosure of which is incorporated herein by reference in its entirety, wherein finely divided particles of a photoconductive inorganic compound are dispersed in an electrically insulating organic resin binder. Other well known electrophotographic imaging layers include amorphous selenium, halogen doped amorphous selenium, amorphous selenium alloys including selenium-arsenic, selenium-tellurium, selenium-arsenic-antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, such as a charge generating layer and a charge transport layer.

Any suitable charge generating or photogenerating material may be employed as one of the two electrically operative layers in the multi-layer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generating layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507, the disclosures of which are incorporated herein by reference in their entirety.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. Nos. 3,121,006 and 4,439,507, the disclosures of which are totally incorporated herein by reference. Organic resinous polymers may be block, random or alternating copolymers. The photogenerating composition or pigment can be present in the resinous binder composition in various amounts. When using an electrically inactive or insulating resin, it is preferred that there be high levels of particle-to-particle contact between the photoconductive particle population. This condition can be achieved, for example, with the photoconductive material present, for example, in an amount of at least about 15 percent by volume of the binder layer with no limit on the maximum amount of photoconductor in the binder layer. If the matrix or binder comprises an active material, for example, poly-N-vinylcarbazole, the photoconductive material need only to comprise, for example, about 1 percent or less by volume of the binder layer with no limitation on the maximum amount of photoconductor in the binder layer. Generally for charge generator layers containing an electrically active matrix or binder such as poly-N-vinyl carbazole or phenoxy-poly(hydroxyether), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generating layer.

The thickness of the photogenerating binder layer is not particularly critical. Layer thicknesses from about 0.05 micrometer to about 40.0 micrometers may be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, for example, 4,000 Angstroms to 8,000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generating layer is a material which is an insulator to the extent that an electrostatic charge placed on the transport layer is not conductive in the absence of illumination, that is, does not discharge at a rate sufficient to prevent the formation and retention of an electrostatic latent image thereon.

An especially preferred transport layer employed in one of the two electrically operative layers in the multi-layer photoconductor embodiment of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines for charge transport layers capable of supporting the injection of photogenerated holes of a charge generating layer and transporting the holes through the charge transport layer include triphenylmethane, bis(4-diethylamine-2-methylphenyl) phenylmethane; 4'-4"-bis(diethylamino)-2', 2"-dimethyltriphenyl-methane, N,N'-bis(alkylphenyl)-[1,1'-biphenyl]-4,4'-diamine wherein the alkyl is, for example, methyl, ethyl, propyl, n-butyl, and the like, N,N'-diphenyl-N,N'-bis(chlorophenyl-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as LEXAN 145™ from General Electric Company; poly(4,4'-isopropylidene-diphenylene carbonate) with a molecular weight of from about 40,000 to about 45,000, available as LEXAN 141™ from the General Electric Company; a polycarbonate resin having a molecular weight of from about 50,000 to about 100,000, available as MAKROLON™ from Farbenfabricken Bayer A.G., a polycarbonate resin having a molecular weight of from about 20,000 to about 50,000 available as MERLON™ from Mobay Chemical Company and poly(4,4'-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

If desired, the charge transport layer may comprise any suitable electrically active charge transport polymer instead of a charge transport monomer dissolved or dispersed in an electrically inactive binder. Electrically active charge transport polymer employed as charge transport layers are described, for example, in U.S. Pat. Nos. 4,806,443; 4,806,444; and 4,818,650, the disclosures thereof being totally incorporated herein by reference.

Any suitable and conventional technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the transport layer is between about 5 micrometers to about 100 micrometers, but thicknesses outside this range can also be used. In general, the ratio of the thickness of the charge transport layer to the charge generating layer is preferably maintained from about 2:1 to 200:1 and in some instances as great as 400:1.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

The Example results were obtained through a series of trials and as illustrated herein. Variations on working parameters included changing cycle times, changing solvent flow rates, changing spindle speeds, and employing different sponge configurations. It will be readily evident to one of ordinary skill in the art that when the article for coating is immersion coated with the apparatus of the present invention, the article for coating is positioned and fixed to the above described receiver member before the tank is filled with an appropriate coating mixture. In other embodiments when the article for coating is dip coated with the apparatus of the present invention the article for coating is mounted on a receiver member and thereafter dipped into and removed from the appropriate coating mixtures. It will also be readily evident that receiver article and the coating apparatus of the present invention can be use in multistage or multi-step coating where a combination of immersion coating and dip coating methods are used.

EXAMPLE I

The drum substrate or article for coating was sequentially immersion coated by, or dip-coated into, each of the following coating solutions using the coating apparatus of the present invention, for example, as illustrated in FIG. 4, to form a layered imaging member:

1) an undercoat layer coating solution of NYLON 8 dispersed in isopropanol solvent;

2) a charge generating layer (CGL) coating solution of dibromoanthanthrone, polyvinyl butyral, and cyclohexanone solvent; and 3) a charge transport layer (CTL) coating solution of polycarbonate, N,N'-diphenyl-N,N'-bis(3-methylphenyl)-[1,1'-biphenyl]-4,4'diamine, and methylene chloride solvent.

No bottom edge (BEW) wipe procedure is employed, nor necessary, after each dip or immersion coating step. Each layer after deposition on the substrate is oven dried. The resulting imaging member is free of the three coating layers on the bottom 9.25 millimeters end or edge of the member.

EXAMPLE II

A drum substrate similar to the substrate of Example I was used in a related coating procedure. Again no bottom edge wipe procedure was employed after each dip or immersion coating step. Each layer after deposition on the substrate was oven dried. The resulting imaging member is substantially free of defects and did not require a distinct bottom edge wipe step to achieve the desired result. This procedure and apparatus provides a coated substrate such as a drum with a CTL layer which is substantially defect free from top to bottom, that is end-to-end. The defect free result for dip coating or immersion coating layer or layers enables a manufacturer of a customer replaceable component, such as a photoreceptor belt or drum consumable article, to use a single size roller, such as a bias charge or transfer roller, in the imaging process with a photoreceptor. The bias transfer roller can generally be made of a rubber or relatively firm foam material. The bias transfer roller is typically pressed against or onto the photoreceptor article. As the photoreceptor rotates the bias transfer roller is forced to rotate. The friction and opposing force generates static electricity which charges the photoreceptor. If the photoreceptor has any bubbles in its surface or chunks of foreign material on its surface the friction from the bias transfer roller can cause previously coated layers on the photoreceptor to delaminate and cause irregular or non-uniform charging of the photoreceptor surface. Avoiding this result can provide substantial production cost savings and waste or scrap avoidance. The uniform coating result also allows the CTL layer to wear more evenly over time compared to the uneven coatings obtained from alternative coating apparatuses or processes.

COMPARATIVE EXAMPLE I

In the coated articles prepared from apparatuses without the conofrustum receiver member of the present invention, the coated films optionally removed from about the bottom 10 (+/−2) millimeters of one end of the photoreceptor to eliminate any bubbles from the bottom end of the photoreceptor so that the photoreceptor has an uncoated area at the bottom end of the drum which is smooth and without surface defects, such as bumps formed by bubbles. In an imaging and development apparatus with a coated photoreceptor article, a roller, such as a biased transfer roller, can contact the photoreceptor article or drum at the coating-free bottom end of article and optionally with spacer supports of identical diameter or with spacer supports having differential diameters. The differential diameter spacer supports can provide, for example, a height difference of about 1 to about 50 micrometers, such as 25 micrometers. The present invention in contrast, because of the uniform coating layer thicknesses and the exclusion of coating materials from the interior and the end of the article obviates the need to remove the coating(s) at the bottom end of the article and eliminates the need to use differential diameter spacer supports and permits the use of spacer supports with identical diameters at each end of the roller.

Table 1 shows illustrative comparative data for defect rates that were obtained for a coater apparatus of the prior art which apparatus and coating method did not employ the apparatus and method with a conofrustum receiver member of the present invention. The defect levels observed in the resulting coater articles was considerably greater than the defect levels observed in the resulting coated articles prepared in accordance with the present invention.

TABLE 1

| Coating Method and Apparatus | % Defect #14 Rate | % Defect #56 Rate |
|---|---|---|
| Comparative Example I (Apparatus and method without a conofrustum receiver member) | 10 | 5 |
| Example II (Apparatus and method of the present invention with a conofrustum receiver member) | 0.04 | <0.5 |

Other modifications of the present invention may occur to one of ordinary skill in the art based upon a review of the present application and these modifications, including equivalents thereof, are intended to be included within the scope of the present invention.

What is claimed is:

1. A coating method comprising:

providing an apparatus comprising a tank with a closed base and an open lip end, wherein the tank is adapted to contain a coating formulation, having a closed base end and an open top end, and a receiver member, adapted to receive an article for coating, having at least a cone shape, the base of the cone being attached to the interior and base end of the tank, the receiver member comprising either i) a partially compressible sponge material or ii) a closed cell foam;

press fitting an article for coating onto the base of the receiver member of the apparatus;

partially filling the tank with a coating solution;

removing the coating solution from the tank; and removing the resulting coated article from the receiver member, wherein the interior of the article is free of residual coating solution.

2. A coating method in accordance with claim 1, wherein the method reduces coating defects in the resulting coated article by from about 1 to about 25 percent compared to coating apparatus without a conofrustum shaped receiver member.

3. A coating method in accordance with claim 2, wherein the rate of defect #14 is reduced by from about 5 to about 0.04 percent and the rate of defect #56 is reduced by from about 10 to about 0.5 percent.

4. A coating method according to claim 1, wherein said coating solution contains a charge generating material.

5. A coating method according to claim 1, wherein said coating solution contains a charge transport material.

6. A coating method according to claim 1, wherein said receiver member is free of any contact with the outer surface of said article for coating.

7. A coating method according to claim 1, wherein said article for coating is a hollow cylindrical article.

* * * * *